US011333377B2

(12) United States Patent
Yang et al.

(10) Patent No.: US 11,333,377 B2
(45) Date of Patent: May 17, 2022

(54) HUMIDIFIER WITH WATERPROOF ARRANGEMENT

(71) Applicant: Shenzhen Chenbei Technology Co., Ltd., Shenzhen (CN)

(72) Inventors: Lin Yang, Shenzhen (CN); Hai Yang, Shenzhen (CN)

(73) Assignee: Shenzhen Chenbei Technology Co., Ltd., Guangdong (CN)

( * ) Notice: Subject to any disclaimer, the term of this patent is extended or adjusted under 35 U.S.C. 154(b) by 180 days.

(21) Appl. No.: 16/583,134

(22) Filed: Sep. 25, 2019

(65) Prior Publication Data

US 2020/0378636 A1 Dec. 3, 2020

(30) Foreign Application Priority Data

May 29, 2019 (CN) ..... 201910454659.7

(51) Int. Cl.

| | |
|---|---|
| ***F24F 11/00*** | (2018.01) |
| ***F24F 6/00*** | (2006.01) |
| ***F24F 13/06*** | (2006.01) |
| ***F24F 13/20*** | (2006.01) |

(52) U.S. Cl.

CPC ..... *F24F 11/0008* (2013.01); *F24F 6/00* (2013.01); *F24F 13/06* (2013.01); *F24F 13/20* (2013.01); *F24F 2006/008* (2013.01)

(58) Field of Classification Search

CPC ..... F24F 11/0008; F24F 6/00; F24F 13/06; F24F 13/20; F24F 2006/008; F24F 6/12; F24F 13/00; F24F 6/02; F24F 13/32

See application file for complete search history.

(56) References Cited

U.S. PATENT DOCUMENTS 4,786,301 A * 11/1988 Rhodes ..... F24F 5/0046 62/271
5,677,982 A * 10/1997 Levine ..... F24F 6/00 392/405

(Continued)

FOREIGN PATENT DOCUMENTS

| | | |
|---|---|---|
| CN | 209877257 | * 12/2019 |
| JP | S5996518 | * 6/1984 |
| JP | 2016044925 | * 4/2016 |

OTHER PUBLICATIONS

EPO translation of CN 209877257 (Year: 2019).*
EPO translation of JP2016044925 (Year: 2016).*
Google translation of JPS5996518 (Year: 1984).*

*Primary Examiner* — Stephen Hobson
(74) *Attorney, Agent, or Firm* — Tsz Lung Yeung

(57) ABSTRACT

A humidifier includes a base housing having a receiving cavity and an air outlet, a water tank having a vapor outlet, a vaporizing arrangement having a vaporizer and a fan, and a waterproof arrangement. The waterproof arrangement includes a blocking member movably mounted on the base housing to selectively move between an opened position and a closed position, wherein when the water tank is detached from the base housing, the blocking member is driven to block the air outlet so as to prevent water from passing through the air outlet, wherein when the water tank is attached on the base housing, the blocking member is driven to unblock the air outlet so as to allow air created by the fan to flow through the air outlet.

19 Claims, 14 Drawing Sheets

(56) References Cited

U.S. PATENT DOCUMENTS

| | | | | |
|---|---|---|---|---|
| 5,859,952 | A * | 1/1999 | Levine | F24F 6/00 392/405 |
| 6,974,382 | B1 * | 12/2005 | Swan | F24F 3/14 236/44 A |
| 2004/0020487 | A1 * | 2/2004 | Koch | A61M 16/161 128/203.12 |
| 2008/0093750 | A1 * | 4/2008 | Wang | F24F 6/00 261/66 |
| 2014/0264963 | A1 * | 9/2014 | Barker | F24F 13/00 261/37 |
| 2019/0383503 | A1 * | 12/2019 | Kim | F24F 13/24 |
| 2020/0096213 | A1 * | 3/2020 | Liang | F24F 6/12 |
| 2020/0224895 | A1 * | 7/2020 | Yang | F24F 6/02 |
| 2020/0284451 | A1 * | 9/2020 | Yang | F24F 6/02 |
| 2020/0340694 | A1 * | 10/2020 | Yang | F24F 6/12 |
| 2020/0370769 | A1 * | 11/2020 | Yang | F24F 13/20 |
| 2020/0378636 | A1 * | 12/2020 | Yang | F24F 11/0008 |
| 2020/0393149 | A1 * | 12/2020 | Yang | F24F 6/00 |

* cited by examiner

HUMIDIFIER WITH WATERPROOF ARRANGEMENT

BACKGROUND OF THE PRESENT INVENTION

Field of Invention

The present invention relates to a humidifier, and more particularly to a humidifier comprising a waterproof arrangement which is capable of preventing water from contacting electronic components in the humidifier.

Description of Related Arts

With the improvement of living standards around the world and particularly developed countries, the requirement for indoor air quality is becoming higher and higher. People not only require indoor air temperature to be within a suitable range, but also require a suitable range of indoor air humidity. As a result, various kinds of humidifiers have been made available, such as ultrasonic humidifiers, electric humidifiers, and the likes. These conventional humidifiers may release water vapor in the air and therefore increase the general humidity in the indoor space where the humidifier is located.

A conventional humidifier usually comprises a main housing having a water tank, a vaporizer supported in the main housing, and a fan unit also supported in the main housing. The water tank should be filled with a predetermined amount of water. When the humidifier is turned on, the water in the water tank is vaporized by the vaporizer and the water vapor is blown to a designated indoor space by the fan unit.

A major disadvantage of conventional humidifiers such as the one described above is that when the humidifier has been used for an extended period of time, it needs to be cleaned because dirt may deposit on various parts of the humidifier. However, when cleaning the humidifier, one needs to be very careful because water may pass through air or vapor outlet of the humidifier and enter the chamber where all the electronic components are located. If water enters the chamber (usually inside the main housing) where all the electronic components are located, the humidifier may no longer work properly. In more serious cases, the water may cause short circuits and electric fire. This poses a great safety risk to users of conventional humidifiers.

As a result, there is a need to develop a humidifier which is capable of preventing water from contacting electronic components of the humidifier.

SUMMARY OF THE PRESENT INVENTION

Certain variations of the present invention provide a humidifier comprising a waterproof arrangement which is capable of preventing water from contacting electronic components of the humidifier.

Certain variations of the present invention provide a humidifier comprising a waterproof arrangement which is capable of automatically blocking water from entering an air outlet when a water tank is detached from a base housing.

Certain variations of the present invention provide a humidifier comprising a waterproof arrangement which is capable of automatically unblocking the air outlet when a water tank is attached on the base housing.

In one aspect of the present invention, it provides a humidifier, comprising:

a base housing having a receiving cavity and an air outlet;

a water tank detachably supported by the base housing, the water tank having a water chamber for storing a predetermined amount of water, and a vapor outlet communicated with the air outlet;

a vaporizing arrangement, which comprises:

a vaporizer supported in the receiving cavity of the base housing; and a fan supported in the base housing for creating air flow at the air outlet; and a waterproof arrangement which comprises a blocking member movably mounted on the base housing to selectively move between an opened position and a closed position, wherein when the water tank is detached from the base housing, the blocking member is driven to block the air outlet so as to prevent water from passing through the air outlet, wherein when the water tank is attached on the base housing, the blocking member is driven to unblock the air outlet so as to allow air created by the fan to flow through the air outlet.

This summary presented above is provided merely to introduce certain concepts and not to identify any key or essential features of the claimed subject matter.

DETAILED DESCRIPTION OF THE PREFERRED EMBODIMENT

Figure 1:
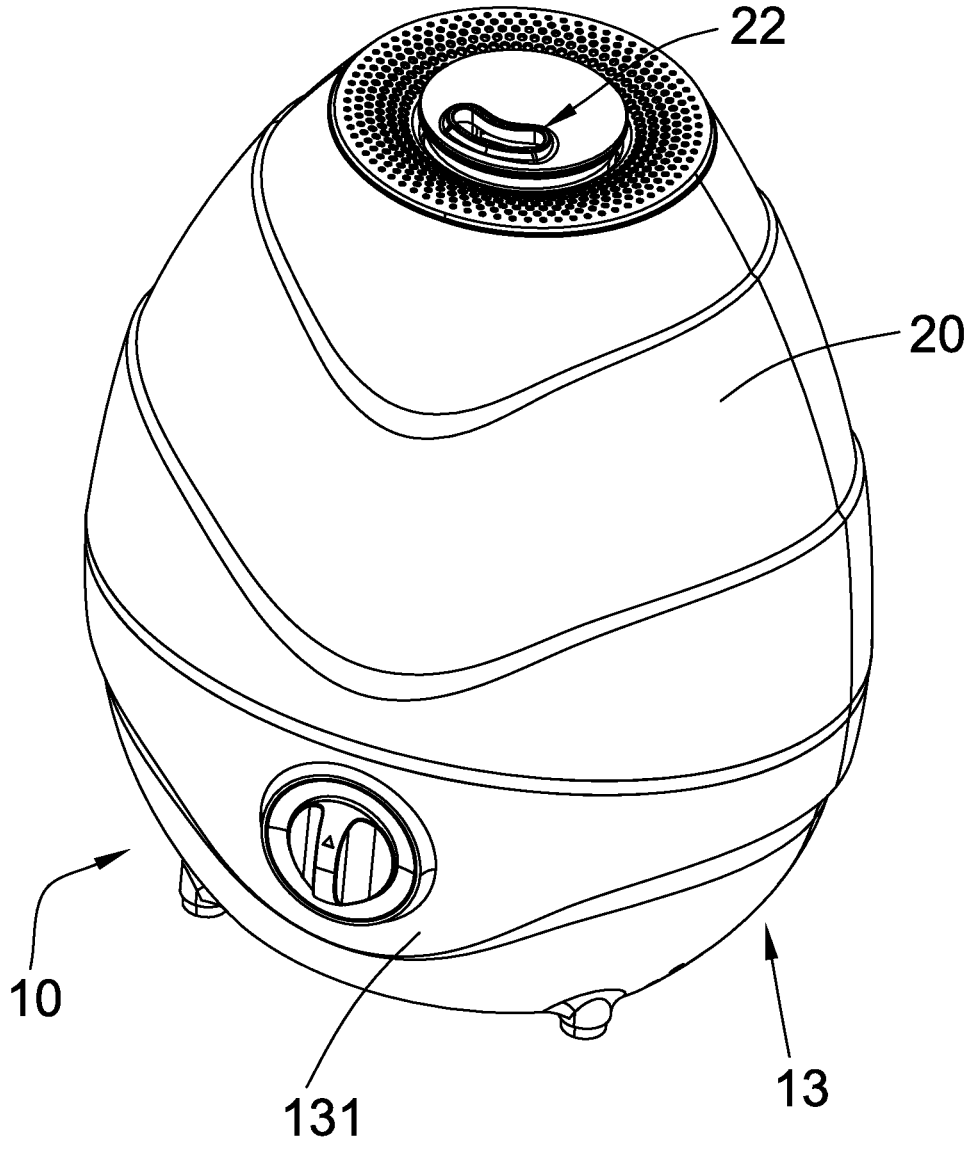
FIG. 1 is a perspective view of a humidifier according to a preferred embodiment of the present invention.

The following detailed description of the preferred embodiment is the preferred mode of carrying out the invention. The description is not to be taken in any limiting sense. It is presented for the purpose of illustrating the general principles of the present invention.

Referring to FIG. 1 to FIG. 12 of the drawings, a humidifier according to a preferred embodiment of the present invention is illustrated. Broadly, the humidifier may comprise a base housing 10 having a receiving cavity 11 and an air outlet 12, a water tank 20, a vaporizing arrangement 30, and a waterproof arrangement 40. The humidifier may be utilized to increase a general humidity of a designated indoor space, such as inside a room. Water may be vaporized and released into ambient air.

The water tank 20 may be detachably supported by the base housing 10, and may have a water chamber 21 for storing a predetermined amount of water. The water tank may further have a vapor outlet 22 communicated with the air outlet 12 of the base housing 10.

The vaporizing arrangement 30 may comprise a vaporizer 31 supported by the receiving cavity 11 of the base housing 10, and a fan 32 supported in the base housing 10 for creating air flow at the air outlet 12.

The waterproof arrangement 40 may comprise a blocking member 41 movably mounted on the base housing 10 to selectively move between an opened position and a closed position, wherein when the water tank 20 is detached from the base housing 10, the blocking member 41 is driven to block the air outlet 12 so as to prevent water from passing through the air outlet 12, wherein when the water tank 20 is attached on the base housing 10, the blocking member 41 is driven to unblock the air outlet 12 so as to allow air created by the fan 32 to flow through the air outlet 12.

Figure 2:
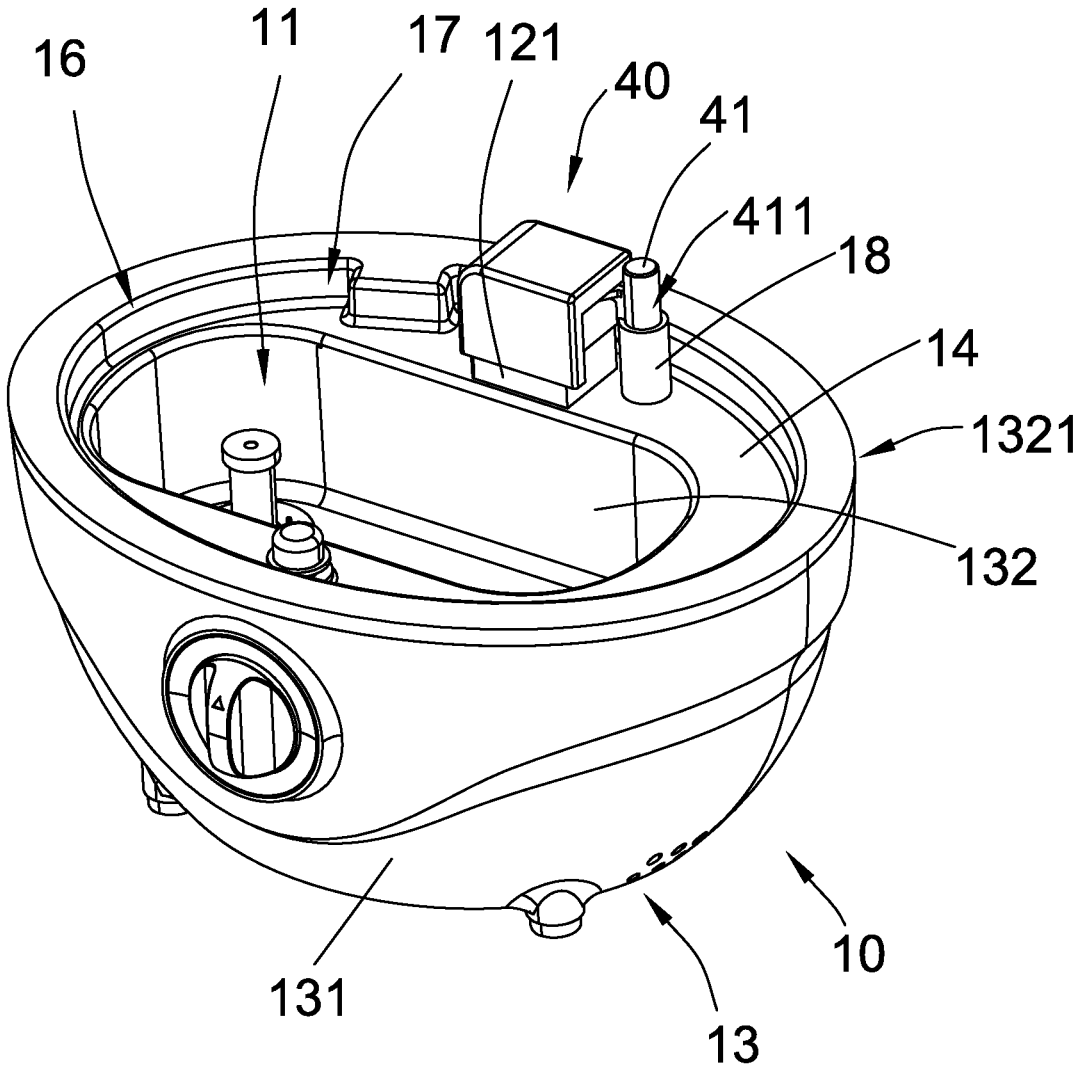
FIG. 2 is a perspective view of a base housing of the humidifier according to the preferred embodiment of the present invention.

According to the preferred embodiment of the present invention, the base housing 10 comprise an outer case 13 and a supporting platform 14 mounted in the outer case 13 to form an accommodating cavity 15 as a space enclosed by the outer case 13 and the supporting platform 14. As shown in FIG. 2 of the drawings, the outer case 13 may have a substantially semi-spherical shape having an inner wall 131 and a circumferential outer wall 132, while the supporting platform 14 may have an annular cross sectional shape when viewed from the top so that the accommodating cavity 15 may be formed as a space enclosed by the inner wall 131 of the outer case 13, the circumferential outer wall 132 of the outer case 13, and the supporting platform 14.

On the other hand, the inner wall 131 of the outer case 13 may have a U-shaped cross section when viewed from one side so as to form the receiving cavity 11 in the space surrounded by the inner wall 131. Moreover, the base housing 10 may further have an access opening 16 formed as a top opening of the receiving cavity 11. The access opening 16 may communicate the receiving cavity 11 with an exterior of the base housing 10 when the water tank 20 is not attached on the base housing 10.

Note that the supporting platform 14 may be formed at a position underneath a top edge 1321 of the circumferential outer wall 132 so as to define a circumferential rim portion 17 of the base housing 10 above the supporting platform 14.

The water tank 20 may be detachably attached on the base housing 10. When the water tank 20 is attached on the base housing 10, the water in the water chamber 21 may be guided to flow into the receiving cavity 11 in a controlled manner so as to allow the vaporizing arrangement 30 to vaporize the water received in the receiving cavity 11.

The water tank 20 may be shaped and sized to fittedly attach on top of the base housing 10. The vapor outlet 22 may be formed on a top portion 23 of the water tank 20, wherein vapor (mixture of water and air) produced by the humidifier may be released to the indoor space through the vapor outlet 22.

The vaporizing arrangement 30 may further comprise a control Printed Circuit Board (control PCB 33) received in the accommodating cavity 15 of the base housing 10. The control PCB 33 may have control circuitry which may be programmed to control the operation of the humidifier. Moreover, the fan 32 may also be received in the accommodating cavity 15. The waterproof arrangement 40 of the present invention may aim to prevent water from accidentally entering the accommodating cavity 15 so as to prevent damage to the control module and the fan 32.

The vaporizer 31 may extend to the receiving cavity 11 of the base housing 10 and may be electrically connected to the control PCB 33 through the inner wall 131 of the outer case 13. The control PCB 33 may therefore control the operation of the vaporizer 31 when water is filled in the receiving cavity 11. The vaporizer 31 may be configured as a ultrasonic vibrator for vibrating water molecules to create vapor.

Figure 4:
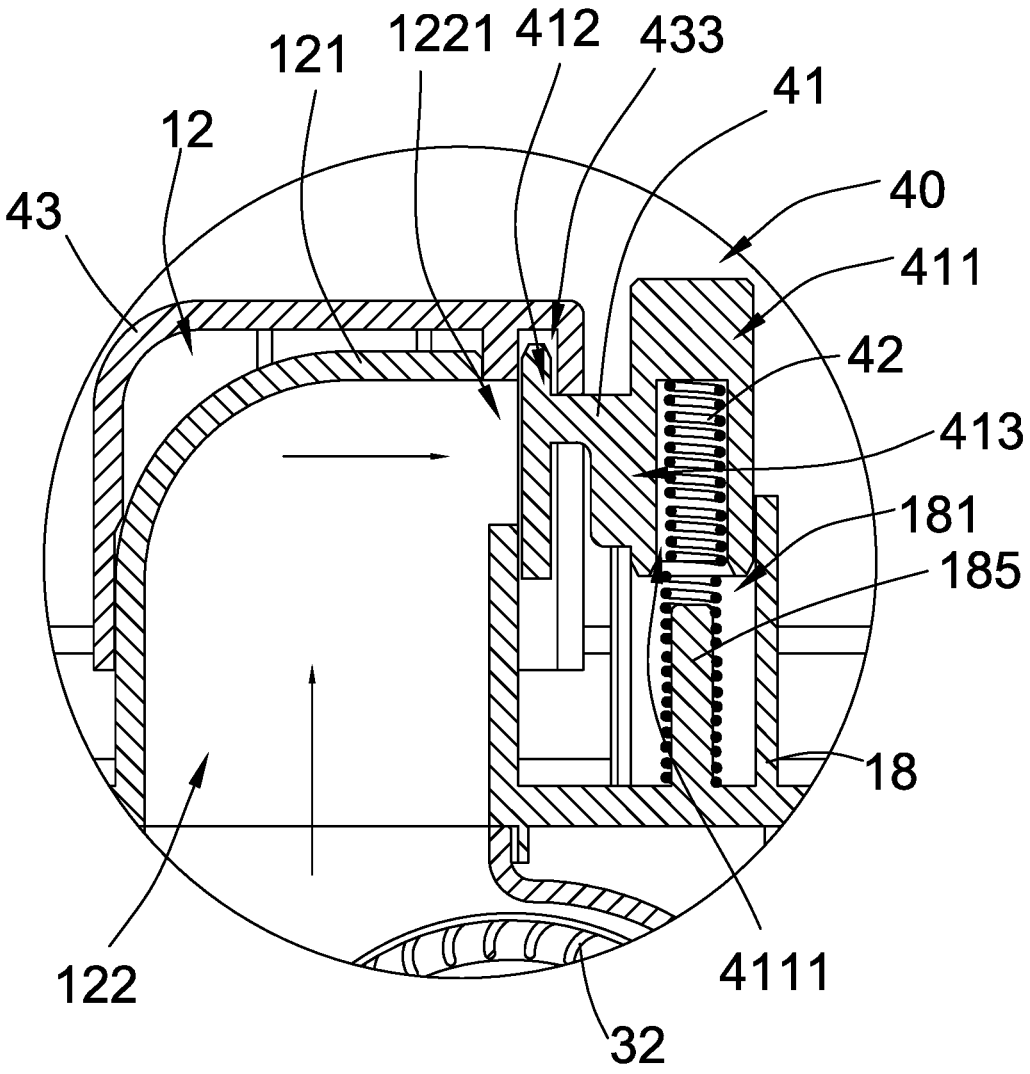
FIG. 4 is a schematic diagram of a waterproof arrangement of the humidifier according to the preferred embodiment of the present invention.
Figure 6:
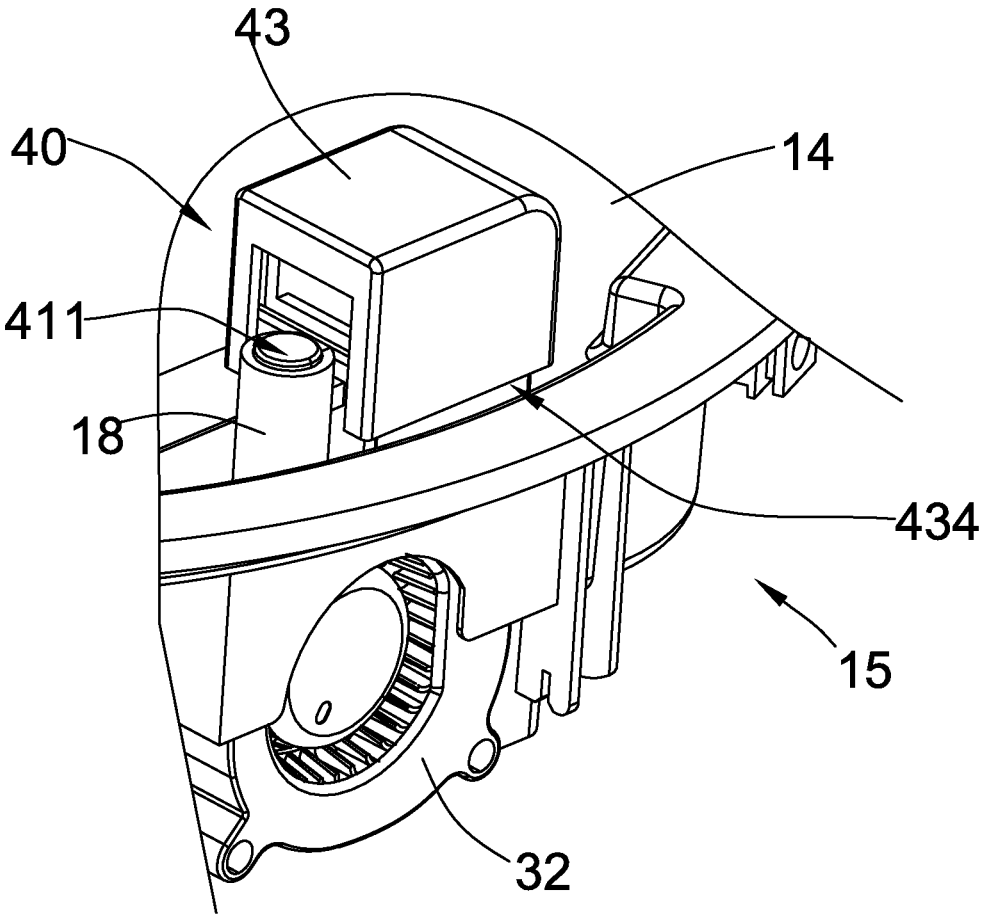
FIG. 6 is a perspective view of the base housing and the waterproof arrangement of the humidifier according to the preferred embodiment of the present invention.
Figure 9:
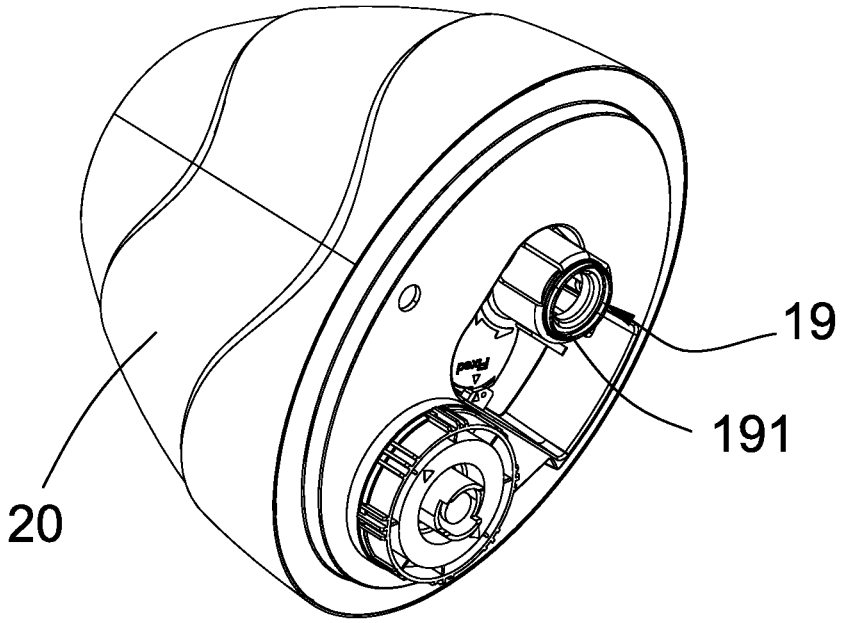
FIG. 9 is a perspective view of a water tank of the humidifier according to the preferred embodiment of the present invention.
Figure 10:
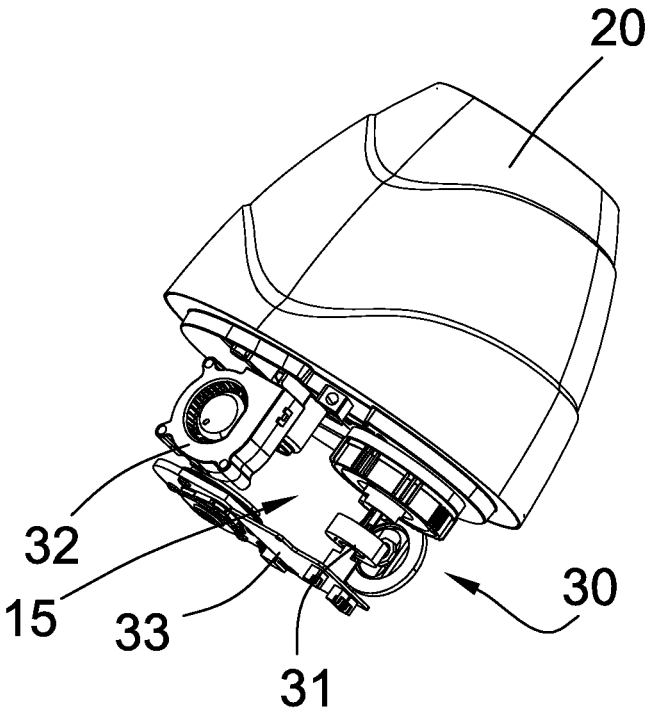
FIG. 10 is a schematic diagram of the water tank and the base housing of the humidifier according to the preferred embodiment of the present invention.
Figure 11:
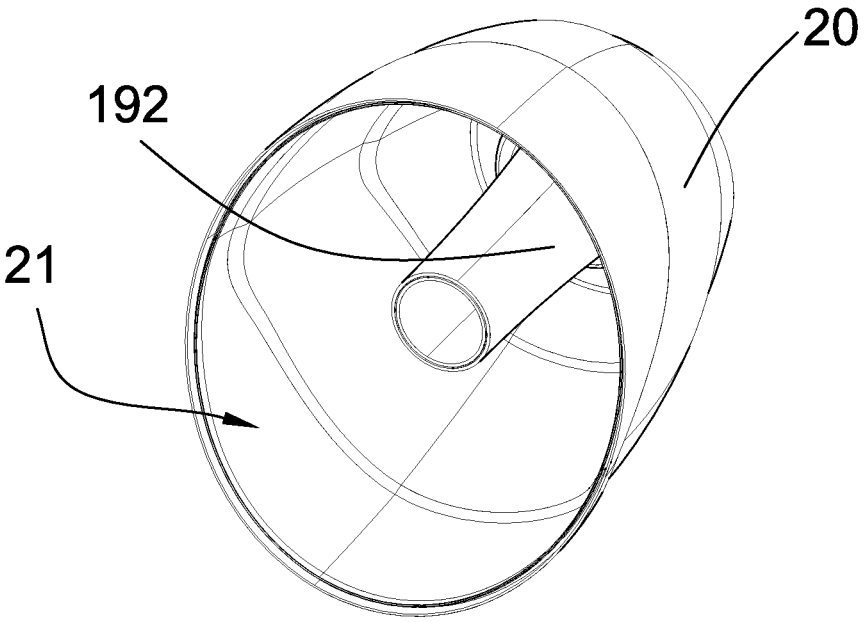
FIG. 11 is another perspective view of the water tank of the humidifier according to the preferred embodiment of the present invention.
Figure 12:
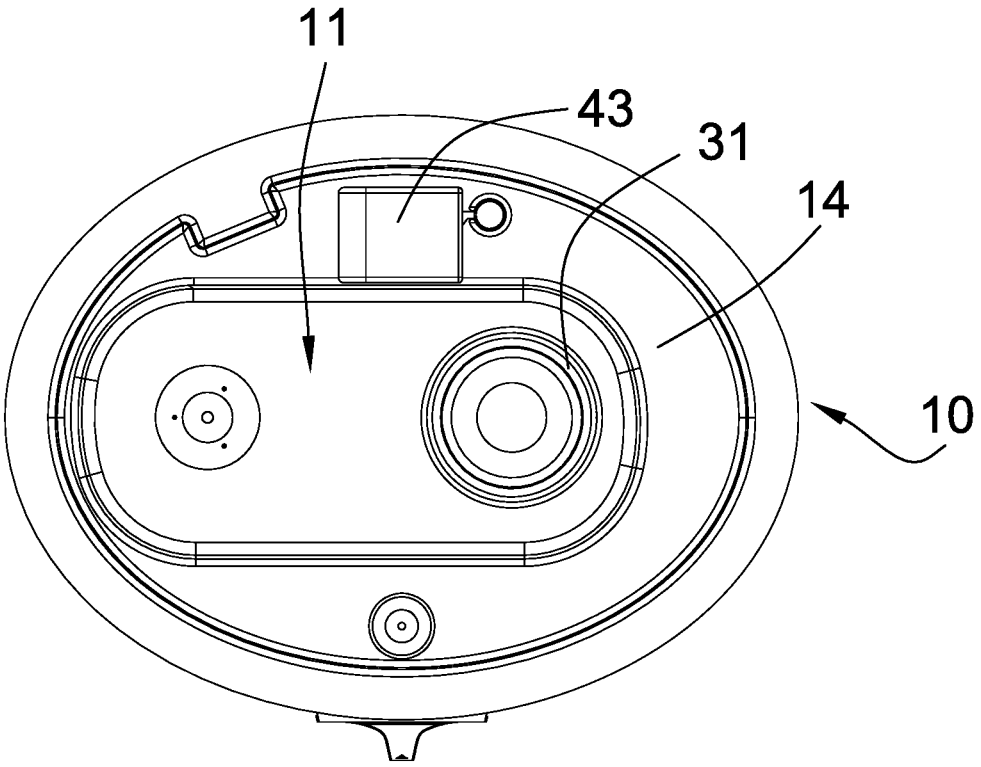
FIG. 12 is a top view of the base housing of the humidifier according to the preferred embodiment of the present invention.

On the other hand, the air outlet 12 of the base housing 10 may comprise an outlet housing 121 and an air outlet channel 122 communicating with the accommodating cavity 15. As shown in FIG. 2 of the drawings, the air outlet 12 may be provided on the supporting platform 14 of the base housing 10 in the vicinity of the circumferential rim portion 17. As shown in FIG. 4 and FIG. 6 of the drawing, when the fan 32 is turned on, the fan 32 may draw air to pass through the air outlet channel 122. The air drawn by the fan 32 may be arranged to drive the vapor generated by the vaporizer 31 in the receiving cavity 11 to flow out of the humidifier through a valve assembly 19 provided on the water tank 20 and the vapor outlet 22. The valve assembly 19 may comprise a valve assembly 191 provided on a bottom portion of the water tank 20, and a water tube 192 extending in the water tank and connecting the valve assembly 191 and the vapor outlet 22, as shown in FIG. 9 and FIG. 11 of the drawings.

The waterproof arrangement 40 may further comprise a retention element 42 mounted on the supporting platform 14 of the base housing 10 for normally exerting an upward force against the blocking member 41 to retain the blocking member 41 in the opened position. Specifically, base housing 10 may further comprise a slider housing 18 provided on the supporting platform 14 at a position in the vicinity of the air outlet 12. The slider housing 18 may have a sliding cavity 181 wherein the retention element 42 may be mounted in the sliding cavity 181 for normally exerting a biasing force against the blocking member 41.

Figure 3:
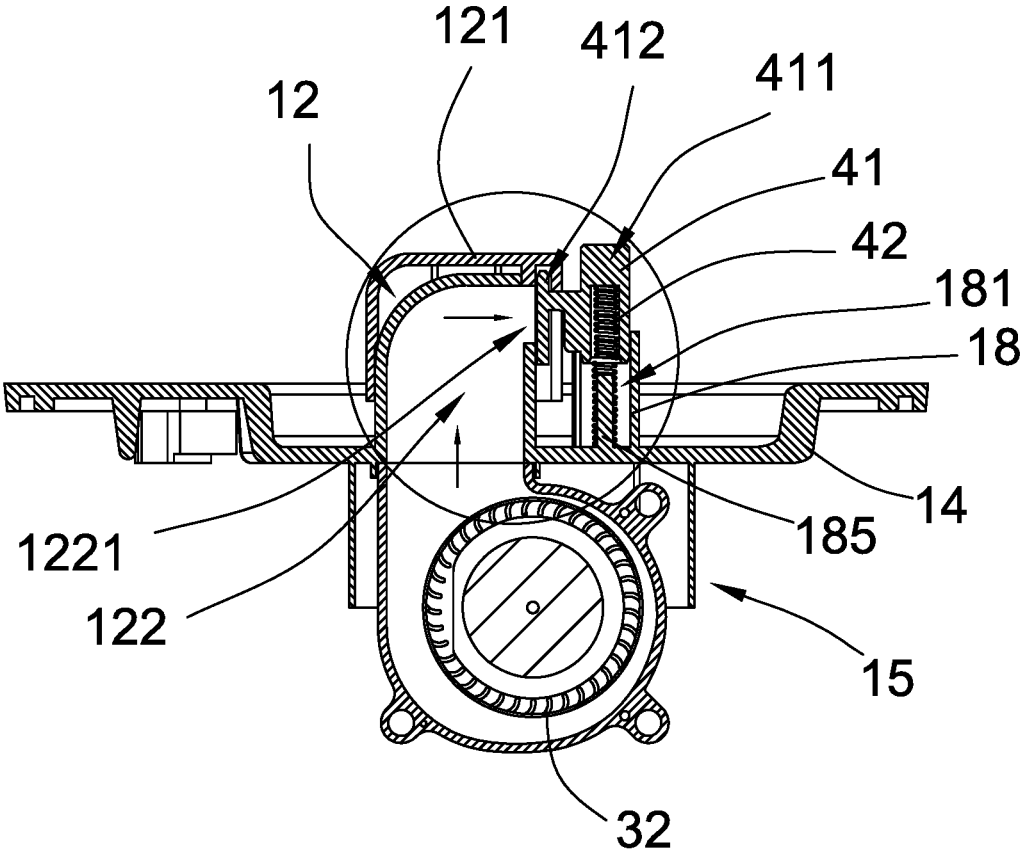
FIG. 3 is a sectional side view of the base housing of the humidifier according to the preferred embodiment of the present invention.
Figure 5:
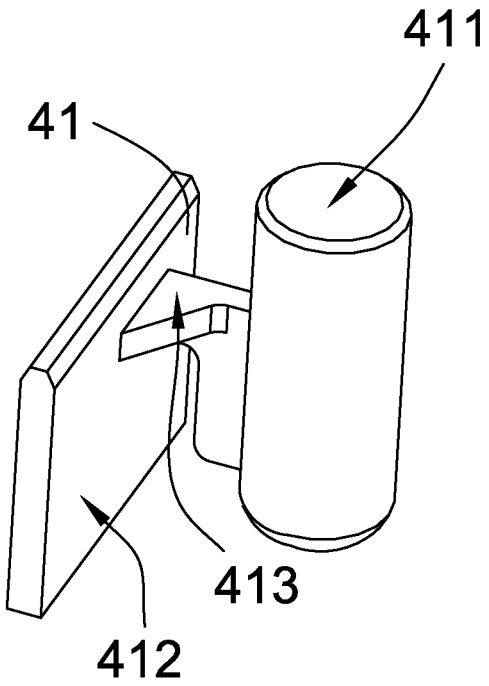
FIG. 5 a perspective view of a blocking member of the waterproof arrangement of the humidifier according to the preferred embodiment of the present invention.

Referring to FIG. 3 to FIG. 5 of the drawings, the blocking member 41 may have a depressing portion 411, a blocking portion 412 and a connecting portion 413 extended between the depressing portion 411 and the blocking portion 412. The blocking member 41 may be supported on the supporting platform 14 in such a manner that the depressing portion 411 may be supported by the slider housing 18 while the blocking portion 412 may movably engage with the outlet housing 121.

The blocking portion 412 of the blocking member 41 may be shaped and sized to be slightly larger than that of the opening 1221 of the air outlet channel 122 so that when the blocking portion 412 is slidably moved next to the opening 1221, the air outlet channel 122 may be physically blocked and foreign substances such as water may be prevented form entering the accommodating cavity 15.

The depressing portion 411 may be movably mounted in the slider housing 18 and may have a central slot 4111 accommodating the retention element 42. The retention element 42 may be configured as a compression spring. Thus, one end of the retention element 42 may be mounted in the central slot 4111 while the other end of the retention element 42 may be mounted on the sliding housing 18. When the water tank 20 is attached on the base housing 10, the depressing portion 411 may be arranged to be depressed along a longitudinal direction the slider housing 18. The depressing motion of the depressing portion 411 may subsequently drive the blocking portion 412 to slide downwardly with respect to the base housing 10 for unblocking the opening 1221 of the air outlet channel 122. At the same time, the retention element 42 may be kept compressed by the weight of the water tank 20 so as to allow the opening 1221 of the air outlet channel 122 to remain opened.

The slider housing 18 may further comprise a guiding member 185 extended in the slider cavity 181, wherein when the blocking member 41 is depressed, the guiding member 185 may be inserted into the central slot 4111 of the depressing portion 411 of the blocking member 41. The retention element 42 may be mounted to the guiding member 185 and in the central slot 4111 of the depressing portion 411. As such, the position of the retention element 42 may be substantially retained.

Figure 7:
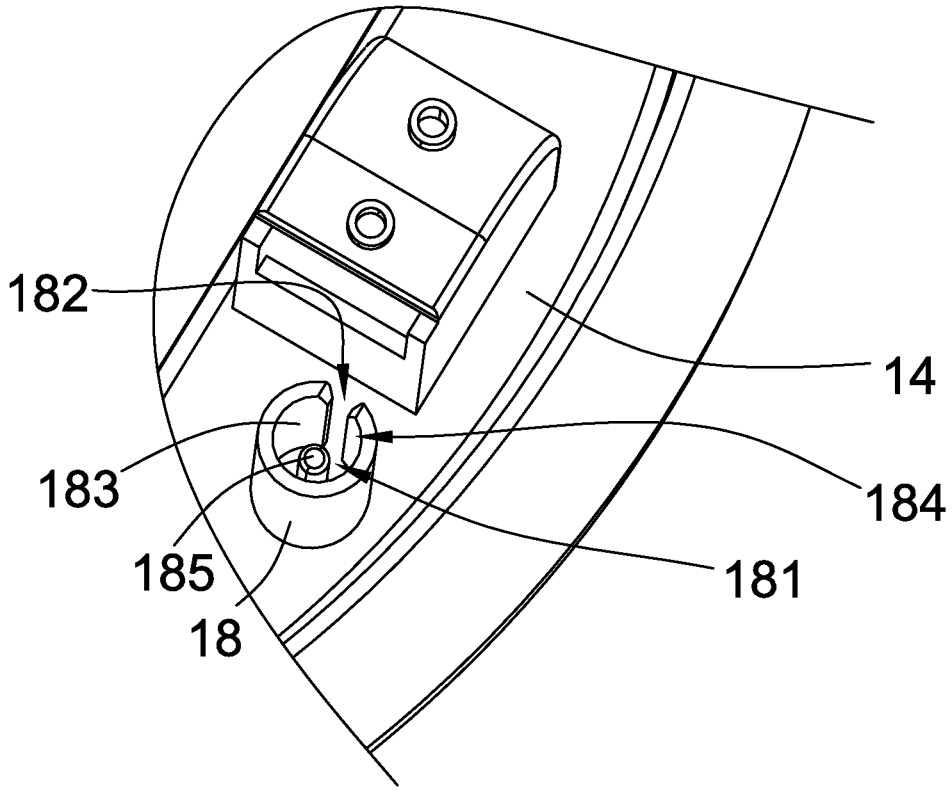
FIG. 7 is a schematic diagram of the waterproof arrangement and the base housing of the humidifier according to the preferred embodiment of the present invention.

As shown in FIG. 7 of the drawings, the slider housing 18 may be positioned corresponding to the outlet housing 121 of the air outlet 12. The slider housing 18 may have a substantially tubular structure and may have a recess 182 formed on a circumferential sidewall 183 of the slider housing 18 for allowing the connecting portion 413 of the blocking member 41 to pass through. Furthermore, the slider housing 18 may have a top housing opening 184 formed as a top opening of the sliding cavity 181, wherein the depressing portion 411 of the blocking member 41 may be slidably mounted in the sliding cavity 181 through the top housing opening 184.

The connecting portion 413 of the blocking member 41 may be configured as a panel-like structure which may slide along the recess 182. The recess 182 may be sized and shaped to fittedly accommodate the connecting portion 413 so that when the blocking member 41 is mounted on the sliding housing 18 and the air outlet 12, the unwanted movement of the connecting portion 413 may be substantially restricted by a surrounding boundary 1821 of the recess 182.

Referring to FIG. 4 and FIG. 7 of the drawings, the opening 1221 of the outlet housing 121 may be formed at an elevated position with respect to the supporting platform 14 so as to prevent residual water on the supporting platform 14 to pass through the opening 1221 of the outlet housing 121. In other words, there exist a predetermined vertical distance between the opening 1221 and the supporting platform 14. Moreover, the outlet housing 121 may have a curved cross section when viewed from the side (see FIG. 4) so as to streamline air flow in the air outlet channel 122 and minimize the noise associated with this flow of air.

Figure 8:
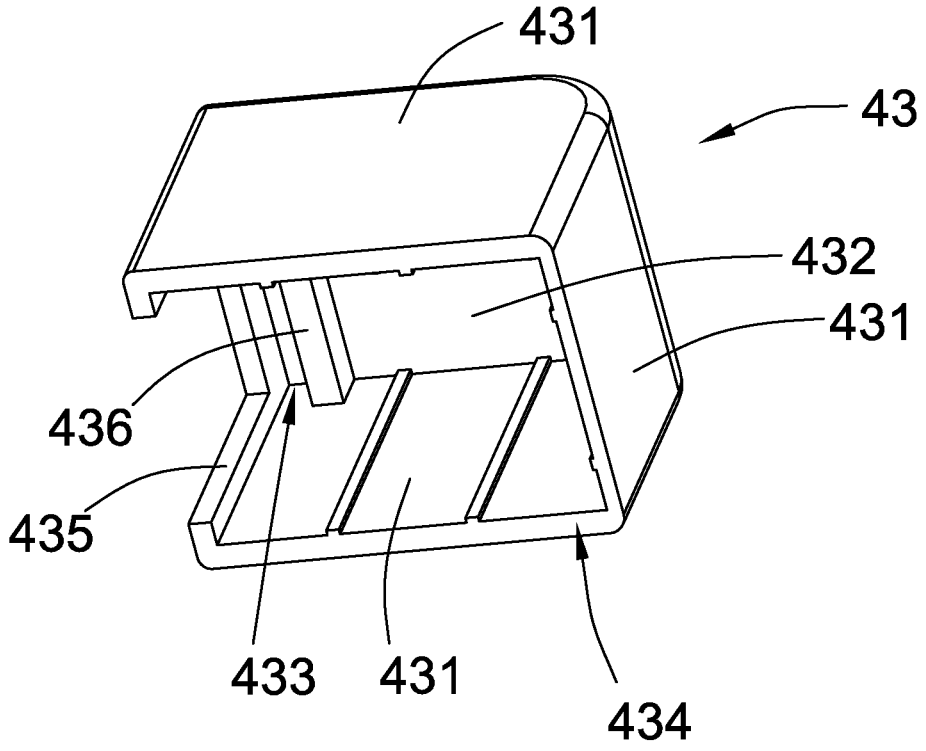
FIG. 8 is a perspective view of a protective housing of the waterproof arrangement of the humidifier according to the preferred embodiment of the present invention.

The waterproof arrangement 40 may further comprise a protective housing 43 detachably mounted on the air outlet 12 for substantially enclosing the outlet housing 121 and the blocking portion 412 of the blocking member 41. As shown in FIG. 4 and FIG. 8 of the drawings, the protective housing 43 may comprise a plurality of side panels 431 and a top panel 432 connected to the side panels 431 to form a substantially cubic or rectangular structure.

The protective housing 43 may further comprise a biasing ridge 436 downwardly extended from the top panel 432, and a securing rim 435 extended from the top panel 432 and the two corresponding side panels 431 to form an engagement groove 433 at a space between the biasing ridge 463 and the securing rim 435. The engagement groove 433 may extended from the top panel 432 and positioned next to the opening 1221 of the air outlet channel 122, wherein the blocking portion 412 of the blocking member 41 may slidably engage in the engagement groove 433 so as to selectively block or unblock the opening 1221 of the air outlet channel 122 as the blocking member 41 moves.

As shown in FIG. 4 and FIG. 8 of the drawings, the securing rim 435 form a front boundary of the engagement groove 433 so that the blocking portion 412 may be slidably received in the engagement groove 433. Note that when the protective housing 43 is detachably mounted on the air outlet 12, a bottom edge 434 of the protective housing 43 may be arranged not to touch the supporting platform 14 so as to prevent water from reaching the protective housing 43 and the air outlet 12. In other words, a predetermined distance may exist between the bottom edge 434 of the protective housing 43 and the supporting platform 14.

The blocking member 41 may form an integral body and may be made of waterproof material such as plastic. When the blocking member 41 is made of plastic, the entire component may be formed by injection molding.

The operation of the present invention is as follows: when the water tank 20 is detachably attached on the base housing, the water tank 20 may depress the depressing portion 411 of the blocking member 41. This may drive the blocking portion 412 of the blocking member 41 to open the opening 1221 of the outlet housing 121. At this time, the blocking member 41 is in the opened position. Air generated by the fan 32 may therefore come out from the air outlet channel 122.

On the other hand, when the water tank 20 is detached from the base housing 10, the retention element 42 may exert an upward biasing force against the depressing portion 411 of the blocking member 41. This upward biasing force may drive the depressing portion 411 to move upwardly and therefore close the opening 1221 of the outlet housing 121. At this time, the blocking member 41 is in the closed position. After the opening 1221 is closed, water may be prevented from entering the accommodating cavity 15 through the opening 1221 and the air outlet channel 122.

Figure 13:
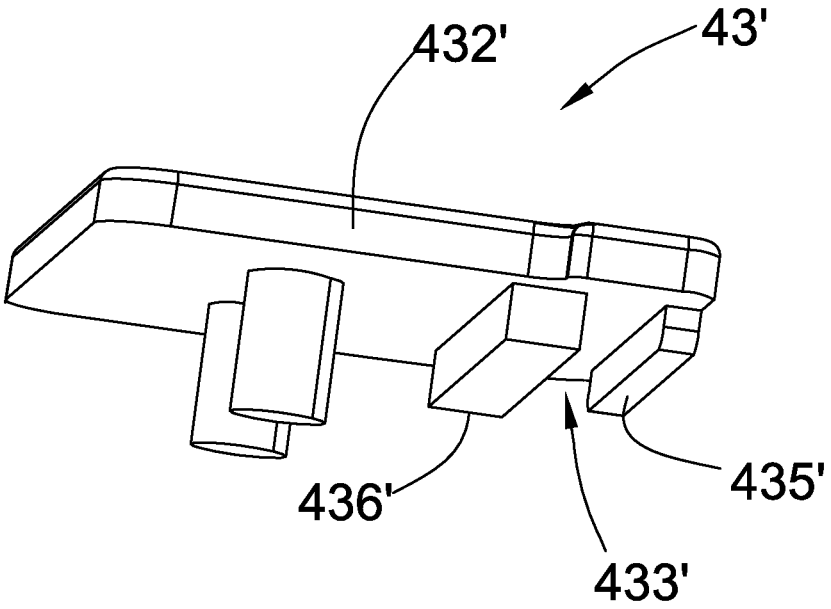
FIG. 13 is a first alternative mode of the waterproof arrangement of the humidifier according to the preferred embodiment of the present invention.

Referring to FIG. 13 of the drawings, a first alternative mode of the humidifier according to the preferred embodiment of the present invention is illustrated. The alternative mode is similar to the preferred embodiment, except the protective housing 43'. According to the alternative mode, the protective housing 43' may comprise a top panel 432', a securing rim 435' and a biasing ridge 436' downwardly extended from the top panel 432' to form the engagement groove 433' between the top panel 432', the securing rim 435' and the biasing ridge 436'. The protective housing 43' may be detachably attached on the air outlet 12 while the blocking portion 412 of the blocking member 41 may be slidably accommodated in the engagement groove 433'.

Figure 14:
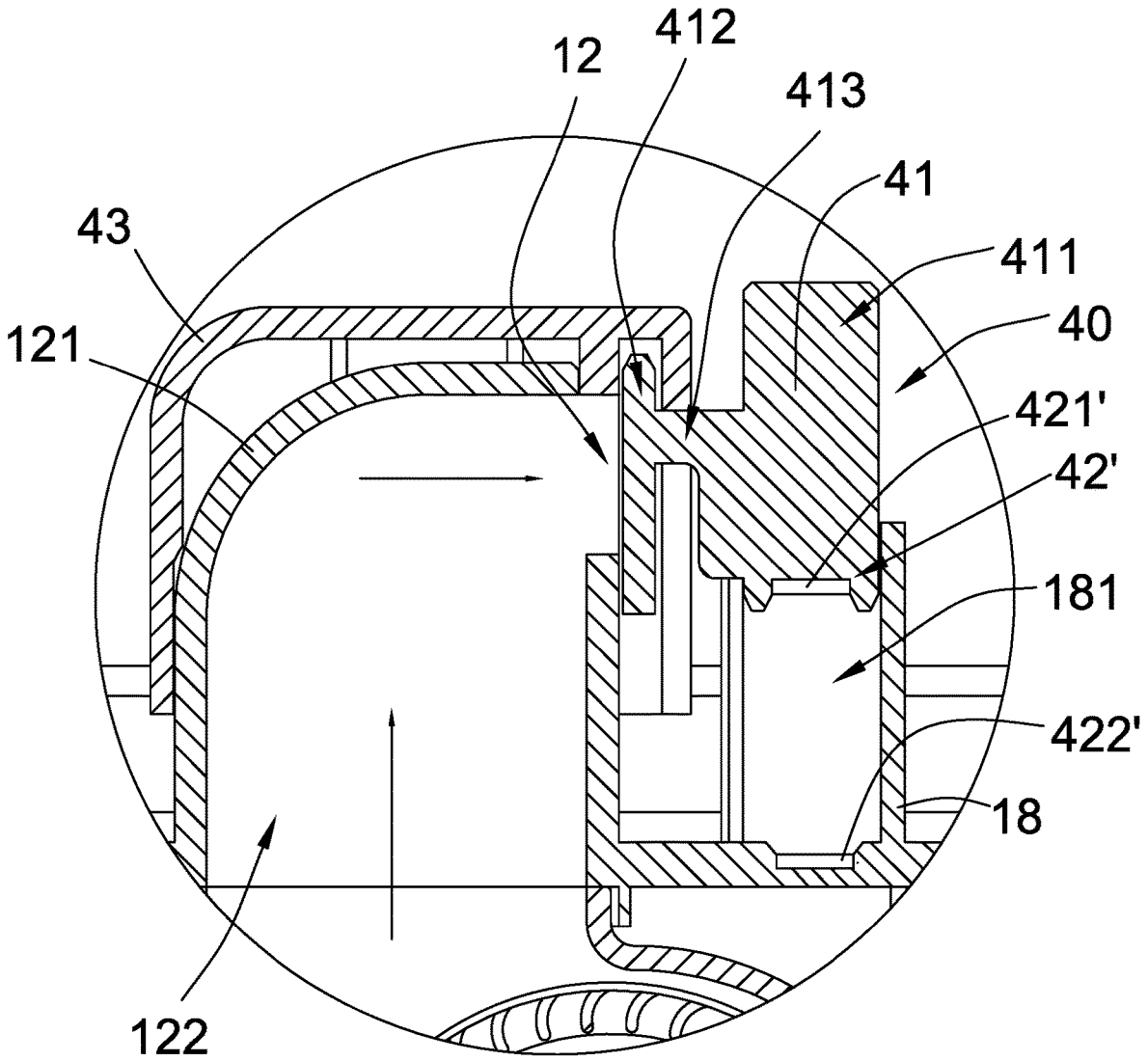
FIG. 14 is a second alternative mode of the waterproof arrangement of the humidifier according to the preferred embodiment of the present invention.

Referring to FIG. 14 of the drawings, a second alternative mode of the humidifier according to the preferred embodiment of the present invention is illustrated. The second alternative mode is similar to the preferred embodiment, except the retention element 42' may comprise a plurality of magnetic elements 421', 422'. According to the second alternative mode, the waterproof arrangement 40 may comprise a plurality of magnetic elements 421', 422' provided on the depressing portion 411 and the slider housing 18 respectively, wherein the magnetic elements 421', 422' may have identical polarity facing each other so that when the water tank 20 is attached on the base housing 10, the weight of the water tank 20 may depress the depressing portion 411 for opening the air outlet channel 122. The weight of the water tank 20 may overcome the expulsion force between the magnetic elements 421', 422' so as to keep the air outlet channel 122 open. However, when the water tank 20 is detached from the base housing 10, the magnetic elements 421', 422' may expel each other and therefore may upwardly push the depressing portion 411 with respect to the base housing 10 for closing the air outlet channel 122.

The present invention, while illustrated and described in terms of a preferred embodiment and several alternatives, is not limited to the particular description contained in this specification. Additional alternative or equivalent components could also be used to practice the present invention.

What is claimed is:

1. A humidifier, comprising:

a base housing having a receiving cavity and an air outlet;

a water tank detachably supported by said base housing, said water tank having a water chamber for storing a predetermined amount of water, and a vapor outlet communicated with said air outlet;

a vaporizer supported in said receiving cavity of said base housing;

a fan supported in said base housing for creating air flow at said air outlet;

a blocking member movably mounted on said base housing to selectively move between an opened position and a closed position, wherein when said water tank is detached from said base housing, said blocking member is driven to block said air outlet so as to prevent water from passing through said air outlet, wherein when said water tank is attached on said base housing, said blocking member is driven to unblock said air outlet so as to allow air created by said fan to flow through said air outlet; and a retention element mounted on said base housing for normally exerting an upward force against said blocking member to retain said blocking member in said opened position, said base housing further comprises a slider housing positioned in a vicinity of said air outlet, said slider housing having a sliding cavity wherein said retention element is mounted in said sliding cavity for exerting a biasing force against said blocking member.

2. The humidifier, as recited in claim 1, wherein said water tank comprises a valve assembly and said air outlet of said base housing comprises an outlet housing and an air outlet channel communicating with said accommodating cavity, wherein when said fan is turned on, said fan is arranged to draw air to pass through said air outlet channel, said air drawn by said fan is arranged to drive said vapor generated by said vaporizer in said receiving cavity to flow out of said humidifier through said valve assembly provided on said water tank and said vapor outlet.

3. The humidifier, as recited in claim 2, wherein said blocking member has a first portion, a second portion and a third portion extended between said first portion and said second portion, said blocking member being supported on said base housing in such a manner that said first portion is supported by said slider housing while said second portion movably engages with said outlet housing.

4. The humidifier, as recited in claim 3, wherein said first portion is movably mounted in said slider housing and has a central slot accommodating said retention element so that one end of said retention element is mounted in said central slot while another end of said retention element is mounted on said sliding housing, wherein when said water tank is attached on said base housing, said first portion is arranged to be depressed along a longitudinal direction said slider housing.

5. The humidifier, as recited in claim 4, wherein said slider housing has a substantially tubular structure and a recess formed on a circumferential sidewall of said slider housing for allowing said third portion of said blocking member to pass through, said slider housing has a top housing opening formed as a top opening of said sliding cavity, wherein said first portion of said blocking member is slidably mounted in said sliding cavity through said top housing opening.

6. The humidifier, as recited in claim 5, wherein said retention element is a compression spring extended on said slider housing and said first portion of said blocking member.

7. The humidifier, as recited in claim 6, wherein said base housing comprise an outer case and a supporting platform mounted in said outer case to form an accommodating cavity as a space enclosed by said outer case and said supporting platform.

8. The humidifier, as recited in claim 7, wherein said outer case of said base housing has an inner wall and a circumferential outer wall, said supporting platform having an annular cross sectional shape when viewed from top so that said accommodating cavity is formed as a space enclosed by said inner wall of said outer case, said circumferential outer wall of said outer case, and said supporting platform.

9. The humidifier, as recited in claim 8, further comprising a protective housing detachably mounted on said air outlet for substantially enclosing said outlet housing and said second portion of said blocking member.

10. The humidifier, as recited in claim 9, wherein said protective housing comprises a plurality of side panels, a top panel connected to said side panels, a biasing ridge downwardly extended from said top panel, and a securing rim extended from said top panel and said two corresponding side panels to form an engagement groove at a space between said biasing ridge and said securing rim, said second portion of said blocking member being slidably engaged in said engagement groove so as to selectively block and unblock said opening of said air outlet channel.

11. The humidifier, as recited in claim 7, further comprising a protective housing detachably mounted on said air outlet for substantially enclosing said outlet housing and said second portion of said blocking member.

12. The humidifier, as recited in claim 11, wherein said protective housing comprises a plurality of side panels, a top panel connected to said side panels, a biasing ridge downwardly extended from said top panel, and a securing rim extended from said top panel and said two corresponding side panels to form an engagement groove at a space between said biasing ridge and said securing rim, said second portion of said blocking member being slidably engaged in said engagement groove so as to selectively block and unblock said opening of said air outlet channel.

13. The humidifier, as recited in claim 3, wherein said retention element comprise a plurality of magnetic elements provided on said first portion and said slider housing respectively, wherein said magnetic elements have identical magnetic polarity facing each other so that when said water tank is attached on said base housing, a weight of said water tank is arranged to depress said first portion for opening said air outlet channel, wherein when said water tank is detached from said base housing, said magnetic elements are arranged to expel each other and upwardly push said first portion with respect to said base housing for closing said air outlet channel.

14. The humidifier, as recited in claim 13, wherein said base housing comprise an outer case and a supporting platform mounted in said outer case to form an accommodating cavity as a space enclosed by said outer case and said supporting platform.

15. The humidifier, as recited in claim 14, wherein said outer case of said base housing has an inner wall and a circumferential outer wall, said supporting platform having an annular cross sectional shape when viewed from top so that said accommodating cavity is formed as a space enclosed by said inner wall of said outer case, said circumferential outer wall of said outer case, and said supporting platform.

16. The humidifier, as recited in claim 15, further comprising a protective housing detachably mounted on said air outlet for substantially enclosing said outlet housing and said second portion of said blocking member.

17. The humidifier, as recited in claim 16, wherein said protective housing comprises a plurality of side panels, a top panel connected to said side panels, a biasing ridge downwardly extended from said top panel, and a securing rim extended from said top panel and said two side panels to form an engagement groove at a space between said biasing ridge and said securing rim, said second portion of said blocking member being slidably engaged in said engagement groove so as to selectively block and unblock said opening of said air outlet channel.

18. The humidifier, as recited in claim 1, further comprising a protective housing detachably mounted on said air outlet for substantially enclosing said outlet housing and said second portion of said blocking member.

19. The humidifier, as recited in claim 18, wherein said protective housing comprises a plurality of side panels, a top panel connected to said side panels, a biasing ridge downwardly extended from said top panel, and a securing rim extended from said top panel and said two corresponding side panels to form an engagement groove at a space between said biasing ridge and said securing rim, said second portion of said blocking member being slidably engaged in said engagement groove so as to selectively block and unblock said opening of said air outlet channel.

* * * * *